US009313579B2

(12) United States Patent
Lee et al.

(10) Patent No.: US 9,313,579 B2
(45) Date of Patent: Apr. 12, 2016

(54) SOUND GENERATOR FOR VEHICLE

(71) Applicants: Hyundai Motor Company, Seoul (KR); Kia Motors Corporation, Seoul (KR)

(72) Inventors: Sang Il Lee, Whasung-Si (KR); Dong Wook Lee, Whasung-Si (KR); Hyoung Jin Yoon, Whasung-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 14/321,526

(22) Filed: Jul. 1, 2014

(65) Prior Publication Data

US 2015/0172821 A1 Jun. 18, 2015

(30) Foreign Application Priority Data

Dec. 18, 2013 (KR) ..... 10-2013-0158093

(51) Int. Cl.

| | |
|---|---|
| ***H04R 1/00*** | (2006.01) |
| ***H04R 9/04*** | (2006.01) |
| *H04R 9/02* | (2006.01) |
| *H04R 9/06* | (2006.01) |

(52) U.S. Cl.

CPC ..... *H04R 9/046* (2013.01); *H04R 9/027* (2013.01); *H04R 9/06* (2013.01); *H04R 2499/13* (2013.01)

(58) Field of Classification Search

USPC ..... 381/396, 410, 389, 412, 152

See application file for complete search history.

(56) References Cited

U.S. PATENT DOCUMENTS

| | | | | |
|---|---|---|---|---|
| 5,936,501 | A * | 8/1999 | Seino | 335/289 |
| 2001/0013729 | A1* | 8/2001 | Hamaguchi et al. | 310/81 |
| 2002/0109424 | A1* | 8/2002 | Iwabuchi et al. | 310/81 |
| 2003/0117223 | A1* | 6/2003 | Shimoda et al. | 331/154 |
| 2004/0218778 | A1* | 11/2004 | Weisman | 381/396 |
| 2005/0073381 | A1 | 4/2005 | Loubat et al. | |
| 2011/0198949 | A1* | 8/2011 | Furuich | H02K 33/16 310/25 |
| 2013/0039526 | A1* | 2/2013 | Inoue | G10K 9/13 381/386 |
| 2014/0118854 | A1* | 5/2014 | Kirii | 359/824 |

FOREIGN PATENT DOCUMENTS

| | | | |
|---|---|---|---|
| JP | H05-85192 | U | 11/1993 |
| JP | 2010-258955 | A | 11/2010 |
| KR | 10-1184286 | B1 | 9/2012 |
| WO | WO 2013/046355 | A1 | 4/2013 |

* cited by examiner

*Primary Examiner* — Brian Ensey
*Assistant Examiner* — Julie X Dang
(74) *Attorney, Agent, or Firm* — Morgan, Lewis & Bockius LLP

(57) ABSTRACT

A sound generator apparatus for a vehicle may include a housing and a elastic member arranged at a lower portion of the housing, a driving part including an internal yoke and a magnet, inserted into the housing and disposed on the elastic member to be slid up and down in the housing, a bobbin, an upper end of which is fixed to an inside upper portion of the housing, extended in a downward direction with wrapping the driving part, wherein a coil is wound along a circumference of the bobbin, and an external yoke fixed to the housing in a cylinder shape wrapping the coil and an outside of the internal yoke therein.

6 Claims, 2 Drawing Sheets

SOUND GENERATOR FOR VEHICLE

CROSS-REFERENCE(S) TO RELATED APPLICATION

The present application claims priority of Korean Patent Application Number 10-2013-0158093 filed on Dec. 18, 2013, the entire contents of which application are incorporated herein for all purposes by this reference.

BACKGROUND

1. Field of the Invention

The present invention relates to a sound generator for a vehicle capable of minimizing a gap, increasing driving power or decreasing the size thereof, and preventing coil damage (improving stability and reliability) by suppressing a transverse flux.

2. Description of Related Art

As a technology for a vehicle has developed recently, the driving sense of a driver has become one element for customers when purchasing a car. Recently, a method of transferring a portion of noise generated from an engine of the vehicle to the driver has been considered. Especially, in case a hybrid automobile or an electric vehicle is driven by utilizing a motor output not an engine output, engine noise or vibration noticeably decreases, and it causes a noticeable decrease of the speed sense or driving sense of the driver.

In the case of the conventional art, a coil part is fixed between an internal yoke and an external yoke, a gap is required at both sides because a yoke vibrates up and down, driving power is decreased due to an exaggerated gap, and because the coil part exists between the yokes vibrating up and down, coil damage (short, magnetic field leakage and so on) occurs due to a transverse flux of the yoke, and there has been a problem of size increase of the yoke due to the gap.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a sound generator for a vehicle capable of minimizing a gap, increasing driving power or decreasing the size thereof, and preventing coil damage (improving stability and reliability) by suppressing a transverse flux.

In an aspect of the present invention, a sound generator apparatus for a vehicle may include a housing and a elastic member arranged at a lower portion of the housing, a driving part including an internal yoke and a magnet, inserted into the housing and disposed on the elastic member to be slid up and down in the housing, a bobbin, an upper end of which is fixed to an inside upper portion of the housing, extended in a downward direction with wrapping the driving part, wherein a coil is wound along a circumference of the bobbin, and an external yoke fixed to the housing in a cylinder shape wrapping the coil and an outside of the internal yoke therein.

A distance between an external surface of the internal yoke and an internal surface of the external yoke is less than a distance between the external surface of the internal yoke and the internal surface of the bobbin.

The internal yoke may include an upper yoke and a lower yoke, respectively, combined to the magnet disposed between the upper yoke and the lower yoke.

The coil may include an upper coil and a lower coil corresponding to the upper yoke and the lower yoke, respectively, and wound directions of the upper coil and the lower coil around the bobbin are opposite from each other.

Heights of the bobbin and the external yoke are higher than a height of the internal yoke.

The internal yoke is located at a middle of the bobbin and the external yoke in a stop state.

The housing including an upper cover and a lower cover combined to an upper end of the external yoke and a lower end of the external yoke, respectively.

The spring is arranged at the lower cover and may include a border portion and a central portion, the central portion being combined with the driving part, and the border portion 640 and the central portion being connected through a bridge.

The upper end of the bobbin is fixed to the upper cover, and a receiving groove in which the bobbin and the coil are received is formed at the internal surface of the external yoke.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
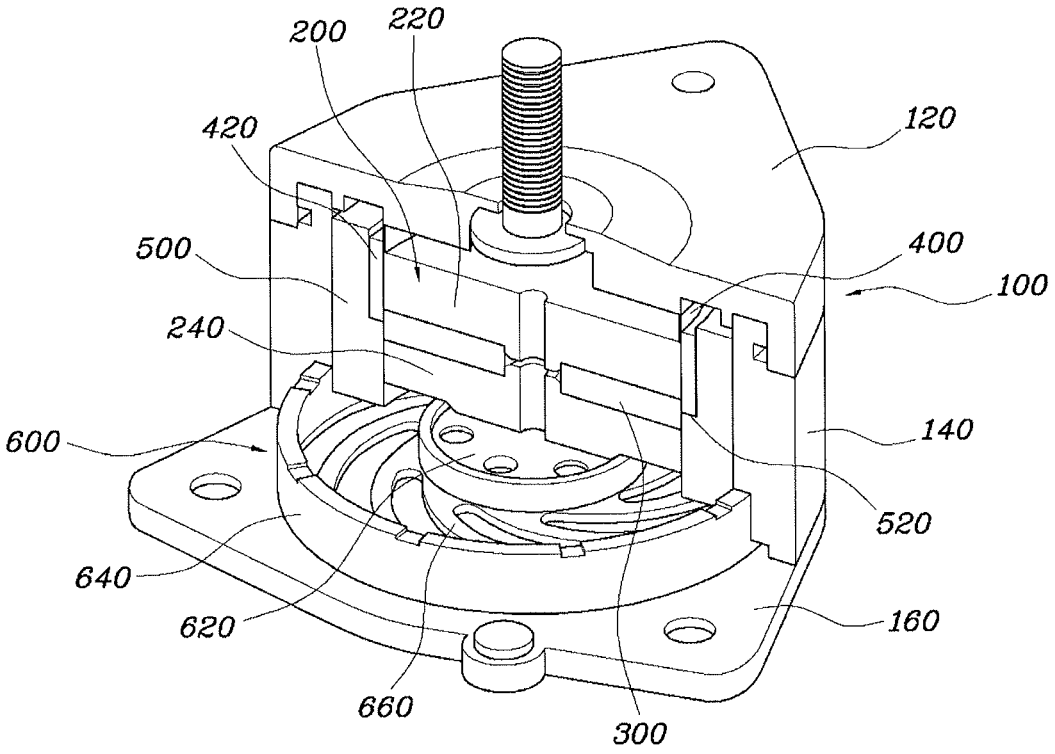
FIG. 1 is a perspective view illustrating a sound generator for a vehicle according to an exemplary embodiment of the present invention.

It should be understood that the accompanying drawings are not necessarily to scale, presenting a somewhat simplified representation of various exemplary features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the inventions(s) will be described in conjunction with exemplary embodiments, it will be understood that the present description is not intended to limit the invention(s) to those exemplary embodiments. On the contrary, the invention(s) is/are intended to cover the exemplary embodiments as well as various alternatives, modifications, equivalents, and other embodiments; which may be included within the spirit and scope of the invention as defined by the accompanying claims.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter, a sound generator for a vehicle is described with reference to the accompanying drawings according to a preferred embodiment of the invention.

Figure 2:
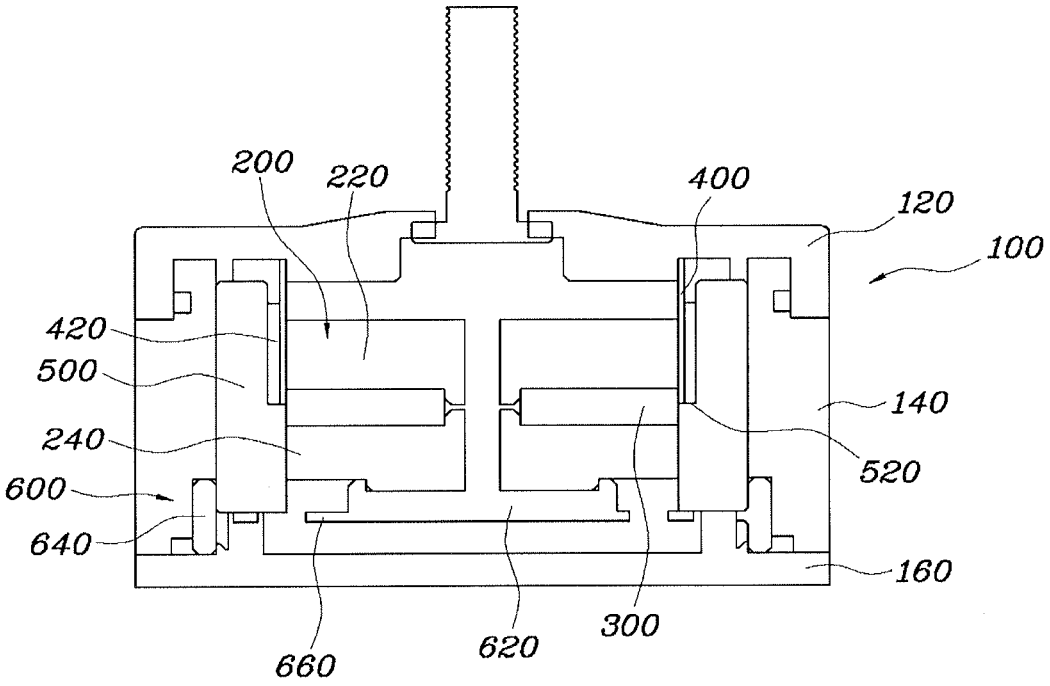
FIG. 2 is a cross-sectional view illustrating the sound generator for a vehicle of FIG. 1.
Figure 3:
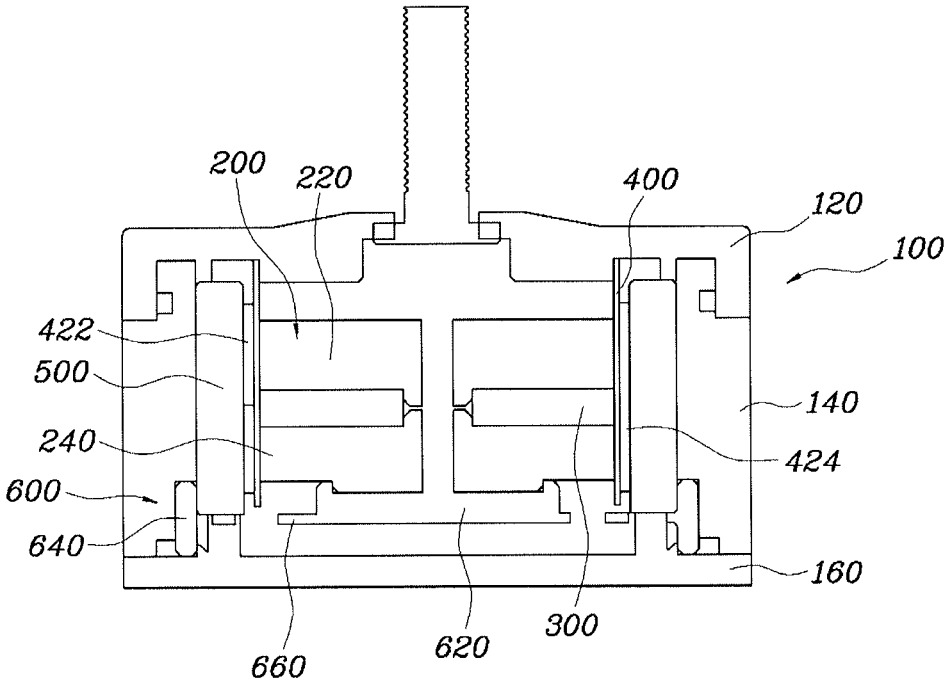
FIG. 3 is a cross-sectional view illustrating a sound generator for vehicle according to another embodiment of the present invention.

FIG. 1 is a perspective view illustrating a sound generator for a vehicle according to an exemplary embodiment of the present invention, FIG. 2 is a cross-sectional view illustrating the sound generator for a vehicle of FIG. 1, and FIG. 3 is a cross-sectional view illustrating a sound generator for a vehicle according to another embodiment of the present invention.

The sound generator for a vehicle according to an exemplary embodiment of the present invention includes: a housing 100 and a spring 600 arranged at the lower portion of the housing 100, a driving part including an internal yoke 200 and a magnet 300, inserted into the housing 100 and seated on the spring 600 to be slid up and down, a bobbin 400 of which an upper end is fixed to the inside upper portion of the housing 100, extended in a downward direction in the form of wrapping the driving part and a coil 420 wound along the circumference of the bobbin 400, and an external yoke 500 fixed to the housing 100 in a cylinder shape wrapping the coil 420 and an outside of the internal yoke 200.

According to the sound generator of the present invention, the driving power is increased and the compacting size thereof is implemented (or improving driving power through increasing a magnet and a coil within the same border size) through minimizing a gap between the yoke and border, and realizing stable performance and improving reliability by preventing damage to coil and leakage of magnetic field with suppressing transverse flux of the driving part (yoke+magnet).

For this purpose, according to an exemplary embodiment of the present invention a conventional driving part is arranged as being divided into the internal yoke and the external yoke. The external yoke is fixed with the bobbin and the coil. Therefore, they can be integrated without a gap, and only the internal yoke vibrates up and down, thus the bobbin, the coil and the internal yoke need a minimum gap. The external yoke may have a shape minimizing a gap with the internal yoke so as to minimize loss due to division of the internal yoke and the external yoke.

In an exemplary embodiment of the present invention, the yoke formed on both sides of the coil and the bobbin is separated (divided), and the external yoke is fixed, so as to solve conventional problems. Thus, only the internal yoke vibrates up and down, therefore a gap between the coil and the external yoke and a gap between the external yoke and the housing are not required, and thus driving power may be increased (or size may be decreased) because the magnet and the yoke may be increased.

The external yoke simply has a function of a magnetic path, therefore a gap against other component is not needed to the external yoke, and the external yoke serves as a guide for preventing transverse flux of the internal yoke by minimizing the gap with the internal yoke (by forming a gap less than a gap between the internal yoke, and the bobbin and the coil). Thus, it may prevent coil damage. In addition, the bobbin wrapping the coil is formed toward the internal yoke (a vibrator), and thus the bobbin does not directly damage the coil although a gap therebetween is very small. That is, according to an exemplary embodiment of the present invention, the yoke is divided into the internal yoke and the external yoke, and the external yoke is fixed.

The bobbin, the coil, the external yoke, and the housing are fixed, and the external yoke and the housing may be integrated or the external yoke may replace the housing. The external yoke serves to guide the upward and downward direction of vibration of the internal yoke. It is because a principle of the gap between the external yoke to the internal yoke<the gap between the internal yoke to the bobbin is applied.

Through this configuration of the sound generator, it is possible to minimize the gap, increase a driving power, or decrease size of the sound generator. Additionally, it is possible to prevent damage to the coil through suppression of the transverse flux (improve stability and reliability).

FIG. 1 is a diagram illustrating the sound generator for a vehicle according to an exemplary embodiment of the present invention, FIG. 2 is a cross-sectional view illustrating the sound generator for vehicle of FIG. 1 wherein the spring 600 of the sound generator for a vehicle of the present invention is arranged at the lower portion of the housing 100, the driving part includes the internal yoke 200 and the magnet 300, inserted into the housing 100 and seated on the spring 600 to be slid up and down.

Such an internal yoke 200 may include an upper yoke 220 and a lower yoke 240 with interposing the magnet 300 therebetween.

In addition, the upper end of a bobbin 400 is fixed to the inside upper portion of the housing 100, and is extended downward with wrapping the driving part, and the coil 420 is wound along the circumference of the bobbin 400. In addition, the external yoke 500 is fixed to the housing 100 in a cylinder shape wrapping the coil 420 and the outside of the internal yoke 200.

Through this configuration of the sound generator, a distance between an external surface of the internal yoke 200 and an internal surface of the external yoke 500 may be less than a distance between the external surface of the internal yoke 200 and an internal surface of the bobbin 400. That is, the distance between the external surface of the internal yoke 200 and the internal surface of the bobbin 400 is minimized, and the coil 420 disposed outside is protected through the bobbin 400 from a rolling friction.

In addition, impact applied to the bobbin 400 may be decreased since a distance between an external surface of the internal yoke 200 and an internal surface of the external yoke 500 may be less than a distance between the external surface of the internal yoke 200 and an internal surface of the bobbin 400 and thus the driving part to which force may be applied in a horizontal direction can be supported on the external yoke 500.

Meanwhile, FIG. 3 is a cross-sectional view illustrating a sound generator for a vehicle according to another embodiment of the present invention wherein the coil 420 includes an upper coil 422 and a lower coil 424 corresponding to an upper yoke 220 and a lower yoke 240, respectively, and wound directions of the upper coil 422 and the lower coil 424 around the bobbin 400 may be opposite from each other. Thus, it may apply strong driving force, and the heights of the bobbin 400 and the external yoke 500 may be higher than a height of the internal yoke 200. In addition, the internal yoke 200 may be located at a middle of the bobbin 400 and the external yoke 500 in a stop state. Thus, the internal yoke 200 and the magnet 300 are always disposed on the external yoke 500 although the driving part is damaged and vibrated.

In addition, the housing 100 may include an upper cover 120 and a lower cover 160 combined to an upper end of the external yoke 500 and a lower end of the external yoke 500, respectively. That is, the housing 100 includes the upper cover 120, the lower cover 160 and the external cover 140 of a center wherein the external cover 140 is eliminated and is replaced with the external yoke 500, and the upper cover 120 and the lower cover 160 are combined to the upper end and the lower end of the external yoke 500, respectively.

And in this case, the upper end of the bobbin 400 is fixed to the upper cover, and a receiving groove 520 in which the bobbin 400 and the coil 420 are received may be formed at the internal surface of the external yoke 500.

In addition, the spring 600 may be arranged at the lower cover 160 and includes a border portion 640 and a central portion 620, the central portion 620 is combined with the driving part, and the border portion 640 and the central portion 620 are connected through a bridge 660 so as to serve a spring function.

According to the sound generator for a vehicle formed with the aforementioned structure, it is possible to minimize the gap, increase a driving power or decrease size of the sound generator. Additionally, it is possible to prevent damage to the coil through suppression of the transverse flux (improve stability and reliability).

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A sound generator apparatus for a vehicle comprising:

a housing and an elastic member arranged at a lower portion of the housing;

a driving part including an internal yoke and a magnet, wherein the internal yoke and the magnet are inserted into the housing and disposed on a portion of the elastic member and are configured to be slid up and down in the housing wherein the portion of the elastic member is spaced from the lower portion of the housing;

a bobbin, an upper end of which is fixed to an inside upper portion of the housing, extended in a downward direction with wrapping the driving part, wherein a coil is wound along a circumference of the bobbin; and an external yoke fixed to the housing in a cylinder shape wrapping the coil and an outside of the internal yoke therein, wherein the internal yoke includes an upper yoke and a lower yoke, each of which is combined to the magnet disposed between the upper yoke and the lower yoke, and wherein a distance between an external surface of the lower yoke and an internal surface of the external yoke opposite to the external surface of the lower yoke is less than a distance between the external surface of the upper yoke and the internal surface of the bobbin.

2. The sound generator apparatus for the vehicle according to claim 1, wherein heights of the bobbin and the external yoke are higher than a height of the internal yoke.

3. The sound generator apparatus for the vehicle according to claim 2, wherein the internal yoke is located at a middle of the bobbin and the external yoke in a stop state.

4. The sound generator apparatus for the vehicle according to claim 1, wherein the housing including an upper cover and a lower cover combined to an upper end of the external yoke and a lower end of the external yoke, respectively.

5. The sound generator apparatus for the vehicle according to claim 4, wherein the spring is arranged at the lower cover and includes a border portion and a central portion, the central portion being combined with the driving part, and the border portion and the central portion being connected through a bridge.

6. The sound generator apparatus for the vehicle according to claim 4, wherein the upper end of the bobbin is fixed to the upper cover, and a receiving groove in which the bobbin and the coil are received is formed at the internal surface of the external yoke.

* * * * *